US005918731A

United States Patent [19]

Wecke et al.

[11] Patent Number: 5,918,731

[45] Date of Patent: Jul. 6, 1999

[54] RADIUS ACTUATOR FOR SAFETY SWITCHES

[75] Inventors: Rolf Wecke, Bückeburg; Roland Mönnings, Porta Westfalica, both of Germany

[73] Assignee: Hans Bernstein Spezialfabrik für Schaltkontakte GmbH & Co., Germany

[21] Appl. No.: 09/184,650

[22] Filed: Nov. 3, 1998

[30] Foreign Application Priority Data

Jan. 26, 1998 [DE] Germany ..... 298 01 192 U

[51] Int. Cl.[6] ..... H01H 27/00

[52] U.S. Cl. ..... 200/329; 200/43.07; 200/17 R

[58] Field of Search ..... 74/96, 107; 200/11 R, 200/11 TW, 17 R, 43.04, 43.07, 43.09, 248, 254, 257, 258, 260, 261, 332, 329, 335, 563, 557

[56] References Cited

U.S. PATENT DOCUMENTS

| | | | |
|---|---|---|---|
| 5,286,935 | 2/1994 | Mina et al. | 200/330 |
| 5,595,286 | 1/1997 | Schulze | 200/335 |
| 5,662,212 | 9/1997 | Wecke et al. | 200/43.04 |

*Primary Examiner*—Michael A. Friedhofer
*Attorney, Agent, or Firm*—Barnes & Thornburg

[57] ABSTRACT

A radius actuator including an actuating member having a shaft which projects into the holder and carries the ball on that end. The ball is fixedly clamped into a clamping part which consists of two halves connected with one another by screws and which is situated in a hollow chamber of the holder. A spring is between the clamping part and the holder in the hollow chamber. The holder is provided with two mounting bores which lead into the hollow chamber and are alignable with the screws of the clamping part.

7 Claims, 2 Drawing Sheets

RADIUS ACTUATOR FOR SAFETY SWITCHES

BACKGROUND AND SUMMARY OF THE INVENTION

The present invention relates to a radius actuator for safety switches, consisting of a holder and an actuating member movably held therein against a spring force between an oblique starting position and a switch actuating position, the actuating member includes a ball on its end situated within the holder.

Safety switches are generally used for the compulsory switching-off of the current supply when, for example, a protective covering is removed from an apparatus or from a machine or housing doors, compartment doors, or the like are opened up.

Safety switches of this type normally have several start openings which are oriented in different directions and through which an actuating member can pass for the purpose of switching. The actuating member moves, for example, together with a door, a flap, or the like. In this case, the radius actuator is fastened to the flap, the door, the lid or the like in a defined position with respect to the flap or the axis of rotation of this part.

Radius actuators of this type are used when, with respect to the safety switch, the actuator can be arranged only on a small swivel radius on the door, the flap or the lid. The design must be such that, in the starting phase, the radius actuator has an oblique position (starting position) with respect to the safety switch so that, in the case of a small swivel radius, it can enter into the safety switch or its start position or opening without any problem. In the further course of the switch operation, for the actuating, for example, of a switch wheel of such a safety switch, can take up a switch actuating position essentially perpendicular to the element to be actuated. In this case, the spring force provides that the actuating member of the radius actuator will resume the starting position after leaving the safety switch.

It is an object of the present invention to provide a radius actuator of the above-mentioned type which, on the whole, consists of relatively few component parts and whose actuating member, with respect to its initial position, is relatively easily adjustable and fixable relative to the holder.

According to the invention, this object is achieved in that the actuating member has a shaft which projects into the holder and carries the ball on that end. The ball is fixedly clamped into a clamping part which consists of two halves connected with one another by screws and which is situated in a hollow chamber of the holder. A spring is between the clamping part and the holder in the hollow chamber. The holder is provided with two mounting bores which lead into the hollow chamber and are alignable with the screws of the clamping part.

The radius actuator according the present invention consists of an extremely small number of component parts and can nevertheless meet all initially described demands made on such a radius actuator.

For implementing the radius actuator according to the invention, only the holder, the actuating member, itself with the shaft integral to it and having the ball, as well as the clamping part and a spring are required.

The initial adjustment of the actuating member takes place after a slight loosening of the screws which connect the halves of the clamping part with one another. Wherein a radius actuator which is completely mounted per se, adjustment is possible by the mounting bores leading into the hollow chamber of the holder. After the desired initial position has been determined, the two screws are tightened so that now the actuating member forms a constructional unit with its shaft, with the ball provided on the end of the shaft and with the clamping part, which constructional unit can be swivelled within certain limits with respect to the longitudinal axis of the shaft.

A particularly advantageous embodiment of the radius actuator consists of the fact that the holder is provided with two mutually crossing guide slots for the shaft of the actuating bow.

These two guide slots significantly facilitate a precise preadjusting of the initial position of the actuating member. This constructive further development of the holder does not lead to significant additional costs.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 3:
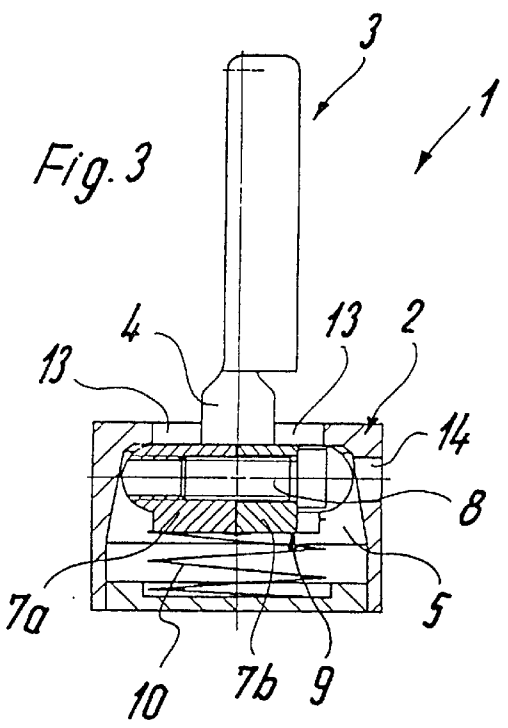
FIG. 3 is a partial sectional view in the direction of arrow III in FIG. 1.
Figure 1:
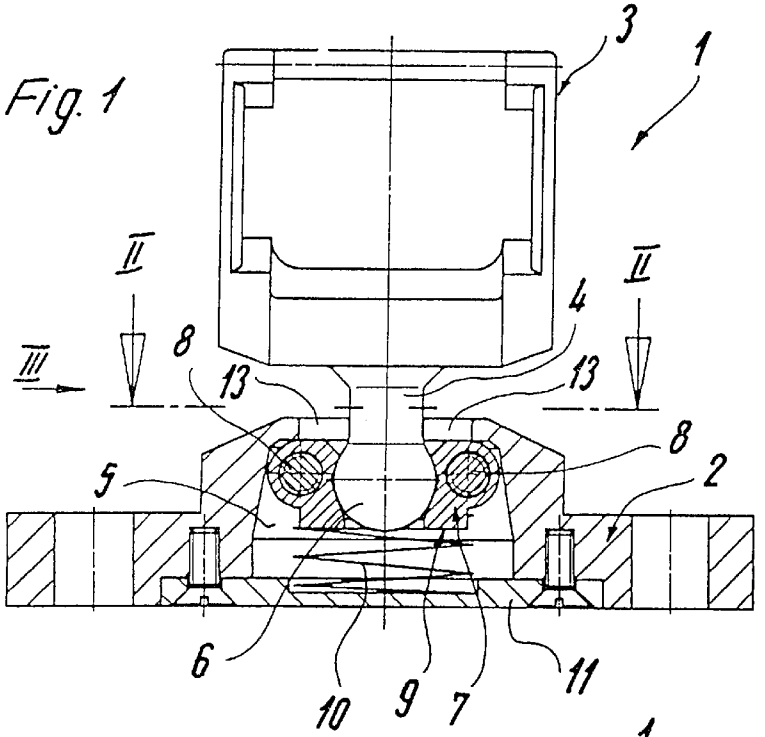
FIG. 1 is a sectional view of a radius actuator according to the invention.

A radius actuator, which is illustrated in the drawings and, on the whole, has the reference number 1, essentially consists of a holder 2 and an actuating bow 3 which is movably held therein against a spring force. The actuating bow 3 is an actuating handle or member shown with a transverse opening.

The actuating member 3 is equipped with a shaft 4 which projects into a hollow chamber 5 of the holder 2 and carries a ball 6 on its end.

The ball 6 is fixedly clamped inside a clamping part 7 shown as pipe-clamp-type clamping part.

The clamping part 7 consists of two halves 7*a* and 7*b* which are mutually connected by screws 8, which is illustrated particularly clearly in FIG. 3.

A face 9 of the clamping part 7 facing away from the actuating member 3 is acted upon by a spring 10 which is situated inside the hollow chamber 5 of the holder 2 and which is supported at its other end on a lid 11 which closes the hollow chamber 5 of the holder 2.

Figure 2:
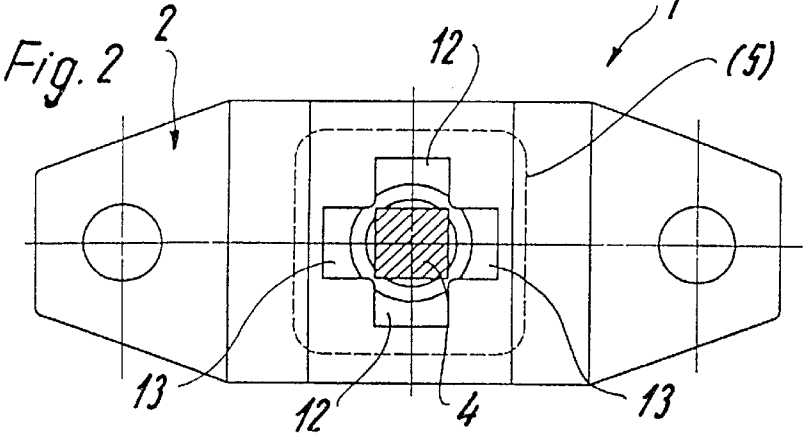
FIG. 2 is a sectional view along Line II—II in FIG. 1.

As illustrated particularly clearly in FIG. 2, in the passage area of the shaft 4, the holder 2 is equipped with two mutually crossing guide slots 12 and 13 for guiding the shaft 4.

FIG. 3 illustrates that the holder 2 is provided with two mounting bores 14 which each lead into the hollow chamber 5 of the holder 2 and are situated in an alignment with the screws 8 of the clamping part 7.

Figure 5:
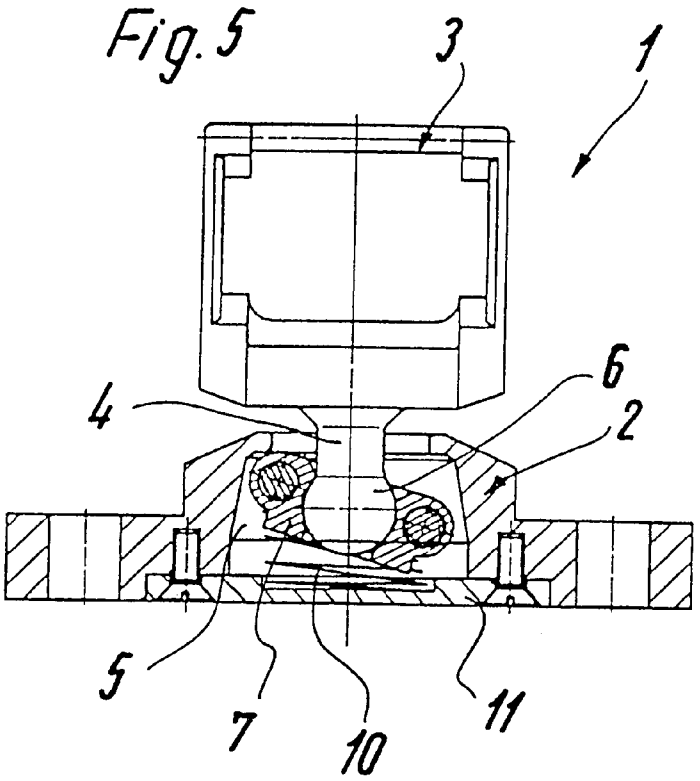
FIG. 5 is a sectional view corresponding to FIG. 4 when the actuating member is in the switch actuating position.
Figure 4:
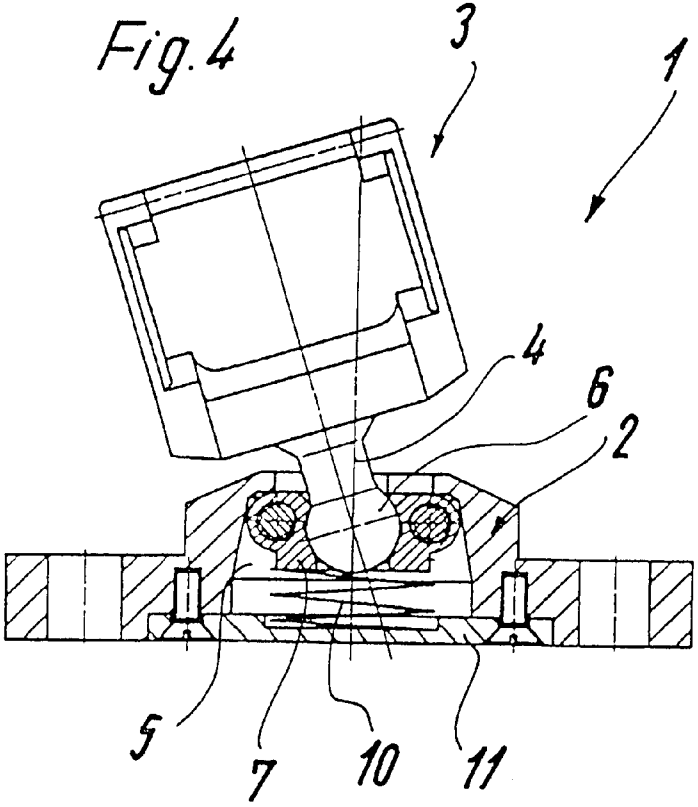
FIG. 4 is a sectional view corresponding to FIG. 1 with a premounted actuating member swivelled with respect to the representation according to FIG. 1.

On the basis of the above-described construction of the illustrated radius actuator, the following functional possibilities are achieved:

After the assembly of all parts, an erecting engineer can slightly loosen the screwed connection of the two halves 7*a* and 7*b* of the clamping part 7 through the mounting bores 14. In this position, he can adjust the initial position of the actuating member 3 with respect to the holder 2 corresponding to the two axis directions of the guide slots 12 and 13. When the desired initial adjustment has been achieved, the two screws 8 are tightened so that now the clamping part 7 forms a rigid constructional unit with the ball 6, the shaft 4 and the actuating member 3. This whole constructional unit can then be swivelled from the preadjusted starting position of the actuating member 3, as illustrated in FIG. 4, into a switch actuating position, as illustrated in FIG. 5. If the radius actuator is subsequently again moved out of the actuating position of a safety switch, the actuating member 3 will resume its starting position according to FIG. 4. Advantageously, the plan form of the hollow chamber 5 is approximately square; the same applies to the outer contour of the clamping part 7 so that a twisting of the clamping part 7 within the hollow chamber 5 is prevented. Other polygram shapes will also prevent twisting.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A radius actuator for safety switches, comprising:

a holder;

an actuating member movably held in the holder against a spring force between an oblique starting position and a switch actuating position;

the actuating member having a shaft which projects into the holder and carries a ball on an end;

the ball being fixedly clamped in a clamping part which consists of two halves connected with one another by screws and which is situated in a hollow chamber of the holder;

a spring position between the clamping part and the holder in the hollow chamber; and two bores in the holder which lead into the hollow chamber and are alignable with the screws of the clamping part.

2. A radius actuator according to claim 1, wherein the holder includes two mutually crossing guide slots for the shaft of the actuating member.

3. A radius actuator according to claim 2, wherein the spring is supported on a lid of the holder closing the hollow chamber.

4. A radius actuator according to claim 3, wherein the hollow chamber and the clamping part have corresponding polygram shapes.

5. A radius actuator according to claim 1, wherein the spring is supported on a lid of the holder closing the hollow chamber.

6. A radius actuator according to claim 1, wherein the hollow chamber and the clamping part have corresponding polygram shapes.

7. A radius actuator according to claim 1 wherein the bores are aligned with the screws of the clamping part in the starting position of the actuating member.

* * * * *